United States Patent [19]

Clinton

[11] 4,396,340

[45] Aug. 2, 1983

[54] HIGH SPEED CAN OPENER AND CRUSHER

[75] Inventor: Richard H. Clinton, Belmont, Calif.

[73] Assignee: Kelly-Moore Paint Company, San Carlos, Calif.

[21] Appl. No.: 246,215

[22] Filed: Mar. 23, 1981

[51] Int. Cl.[3] ..... B30B 9/00; B67B 7/24

[52] U.S. Cl. ..... 414/412; 222/83

[58] Field of Search ..... 414/412, 417; 222/81, 222/82, 83, 87, 394; 100/902, 98 R

[56] References Cited

U.S. PATENT DOCUMENTS

| | | | |
|---|---|---|---|
| 2,008,807 | 7/1935 | Williams | 222/82 |
| 2,150,812 | 3/1939 | Aukerman | 222/87 |
| 2,622,316 | 12/1952 | Borland | 222/87 |
| 3,709,386 | 1/1973 | Jones | 414/421 |
| 3,835,768 | 9/1974 | Kidson | 222/87 |
| 4,126,160 | 11/1978 | Gurtler | 141/91 |

FOREIGN PATENT DOCUMENTS

| | | | |
|---|---|---|---|
| 6714247 | 4/1969 | Netherlands | 414/417 |

*Primary Examiner*—Robert B. Reeves

*Assistant Examiner*—James Barlow

*Attorney, Agent, or Firm*—Edward B. Gregg; Willis E. Higgins

[57] ABSTRACT

This can opener opens and empties cans of their contents rapidly, especially paint and similar cans. The opener has a knife edge dimensioned and configured to penetrate an end, especially the bottom, of the can. There is a positioning means for disposing a can having two ends with one end over the knife edge. A means urges the can downward against the knife edge with sufficient force to cause the knife edge to penetrate the one end of the can. A means for receiving contents from the can is disposed beneath the knife edge. Cans may be opened and emptied in rapid sucession with this opener. An emptied can is moved forward by the positioning of a second can for opening and slides down into a can crusher. A piston operated can crusher cylinder is activated electro/pneumatically to come down and crush the emptied can and remove any remaining contents. When the piston retracts the crushed can drops out of the crusher.

5 Claims, 6 Drawing Figures

HIGH SPEED CAN OPENER AND CRUSHER

BACKGROUND OF THE INVENTION

1. Field of the Invention

This invention relates to a can opener and crusher primarily intended for manufacturing and other high volume environments. More particularly, it relates to an improved form of can opener and crusher which will open and empty a large number of cans containing a product in rapid succession and crush the cans on a mechanized basis.

2. Description of the Prior Art

In the manufacture and canning of any liquid or similar product, and especially in the manufacture and canning of paint, a certain amount of the product or the cans containing it may be unsatisfactory for a variety of reasons. For example, in the case of paint, it may be determined after the paint has been packaged in cans that it failed to meet quality standards. Alternatively, the paint may have exceeded its rated shelf life, a paint formulation may be obsoleted, or acceptable paint may be packaged in bent or otherwise damaged cans.

Whatever the cause for the unacceptability of the paint as packaged in the cans, it is presently conventional practice in the paint industry to open the cans of unacceptable product, reprocess or discard the contents of the cans, and dispose of the empty cans. In the case of paint, the cans are conventionally opened and emptied by hand. In a high volume production environment, it would be advantageous if the cans could be opened, emptied and crushed to remove any remaining contents and reduce the can size for easy disposal, on a mechanized basis.

SUMMARY OF THE INVENTION

Accordingly, it is an object of this invention to provide an opener for cans which will allow rapid removal of the contents of the can.

It is another object of the invention to provide an opener for cans which will open and remove the contents of a substantial number of the cans in rapid succession.

It is a a further object of the invention to provide such a can opener which will crush the empty cans.

The attainment of the foregoing objects may be achieved through use of the novel, mechanized, high-speed can opener and crusher herein disclosed. This can opener has a knife edge dimensioned and configured to penetrate a can end. A positioning means places a can having two ends with one end disposed over the knife edge. An urging means presses the can downward against the knife edge with sufficient force to cause the knife edge to penetrate the one end of the can. A receiving means is disposed beneath the knife edge for receiving the contents of the can as they drain from the opened one end of the can. The opener also desirably includes a pressurized fluid tube connected to a source of air or other fluid under pressure, and having an opening proximate to the knife edge for supplying air or other fluid for urging the contents from the can. The opener also desirably includes a means for crushing the opened can after its contents are removed, which also serves to squeeze out any remaining contents of the can.

In the case of paint cans, the one end of the can is preferably its bottom. Utilizing the can opener of this invention allows paint and similar cans to be opened and emptied of their contents much more rapidly and with substantially less labor than the present manual approach.

The attainment of the foregoing objects, advantages and features of the invention should be more readily apparent to those skilled in the art, after review of the following more detailed description, taken together with the drawings, in which:

DETAILED DESCRIPTION OF THE INVENTION

Figure 1:
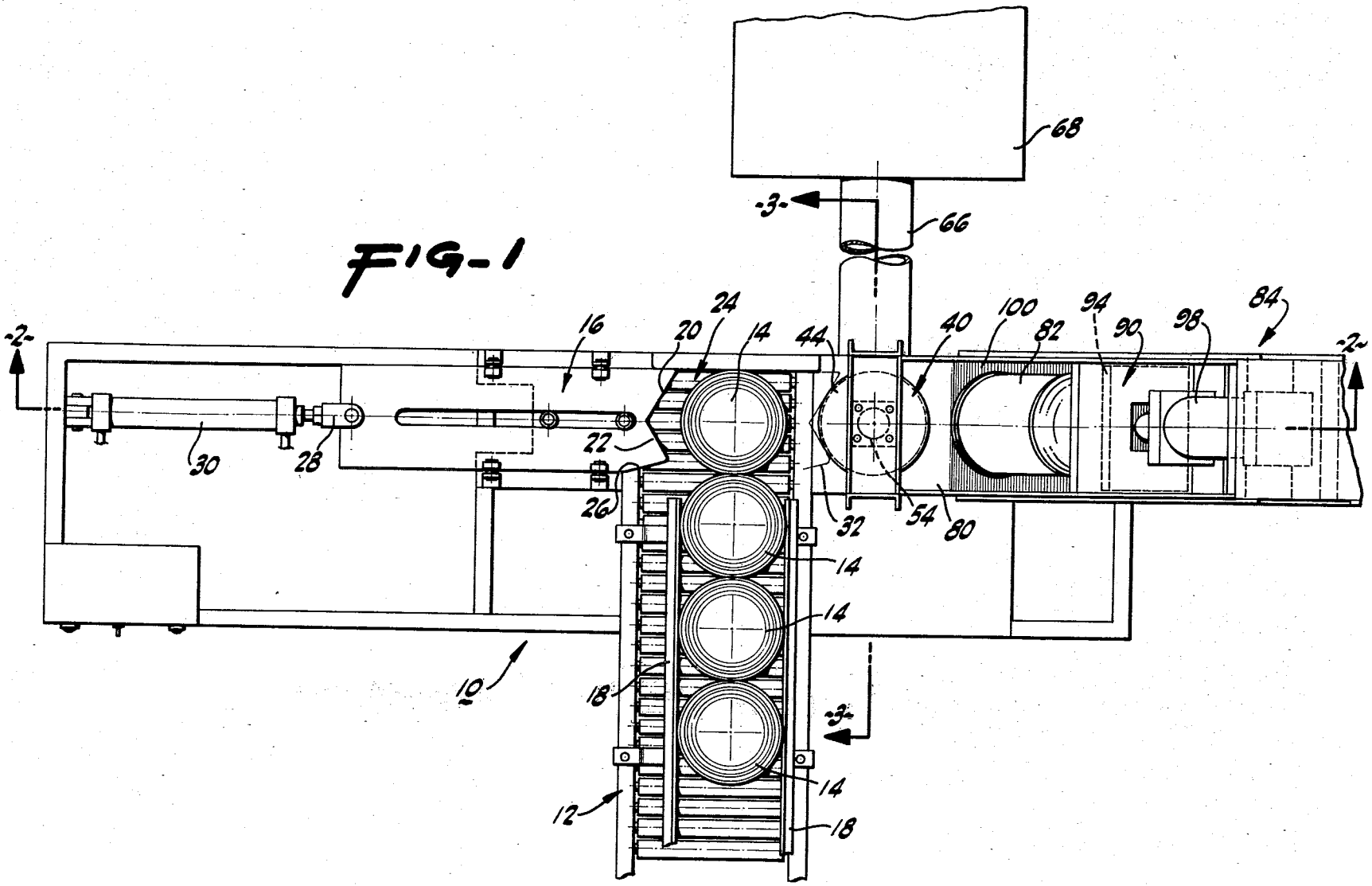
FIG. 1 is a top view of a can opener in accordance with the invention.

Turning now to the drawings, more particularly to FIGS. 1–5, there is shown a can opener 10 in accordance with the invention, suitable for use with paint cans 14. A conventional roller conveyor 12 supplies full paint cans 14 in an erect position opposite a positioning member 16, mounted for reciprocal motion orthogonal to the conveyor 12. Guide rails 18 maintain the cans 14 in a single file. Positioning member 16 has intersecting edges 20 and 22, which engage a can 14 at end 24 of the conveyor 12 when the positioning means 16 moves to the right in FIGS. 1 and 2. Inclined edge 26 of the positioning member 16 engages the next can 14 to prevent it from moving to end 24 of the conveyor 12 when the can 14 at end 24 is pushed to the right by the positioning member 16.

Figure 2:
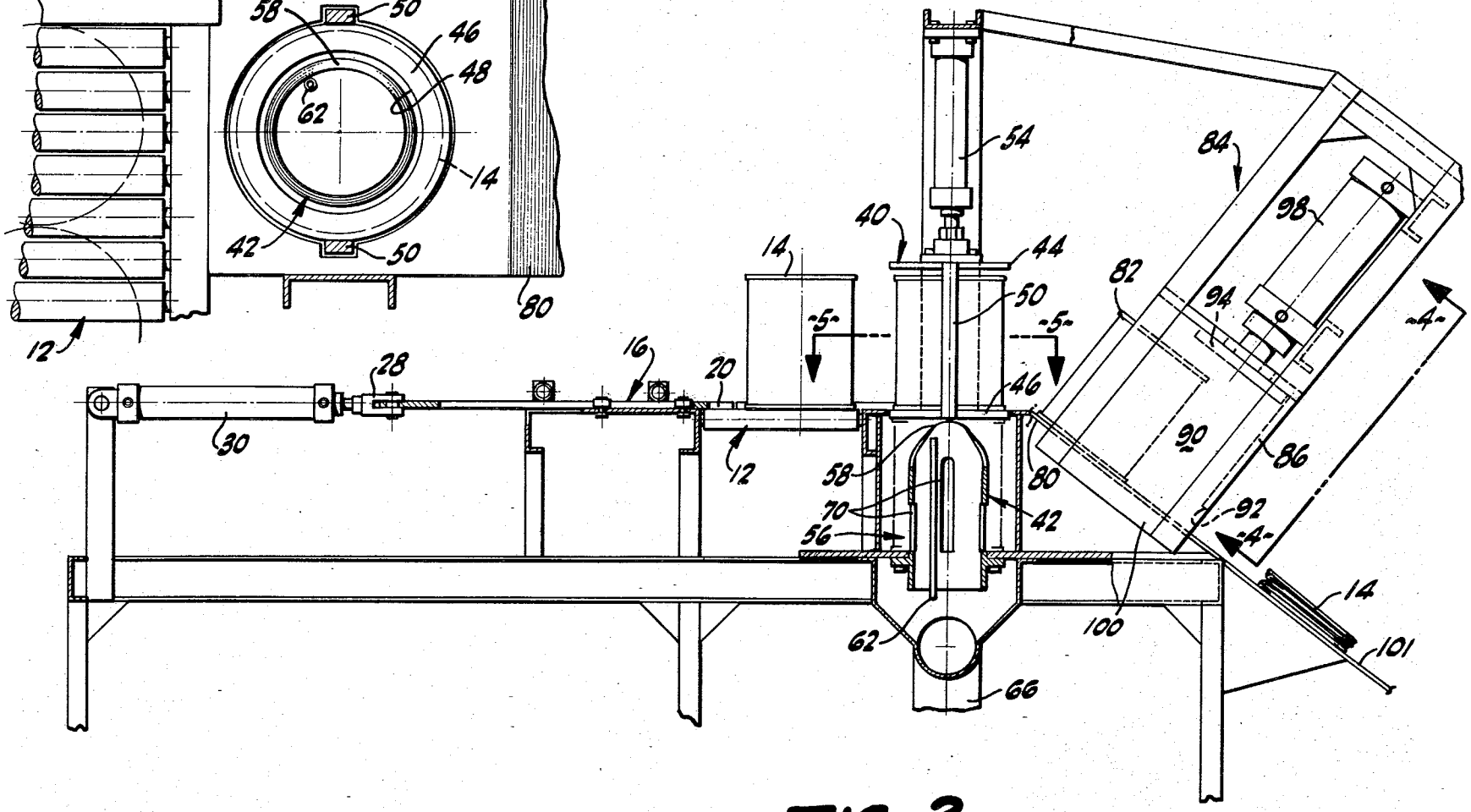
FIG. 2 is a sectional view taken along the line 2—2 in FIG. 1.

Positioning member 16 is connected by linkage 28 to a first bi-directional pneumatic cylinder 30, which operates to reciprocate the positioning member 16 between the position shown in FIGS. 1 and 2 and the position indicated by broken lines 32 at the right of conveyor 12 in FIG. 1. Movement of the positioning member 16 to the position indicated at 32 moves the can 14 from end 24 of the conveyor 12 to a can holder 40, which is positioned above knife edge or blade 42 beside end 24 of the conveyor 12, as shown in FIGS. 1–3.

Figure 3:
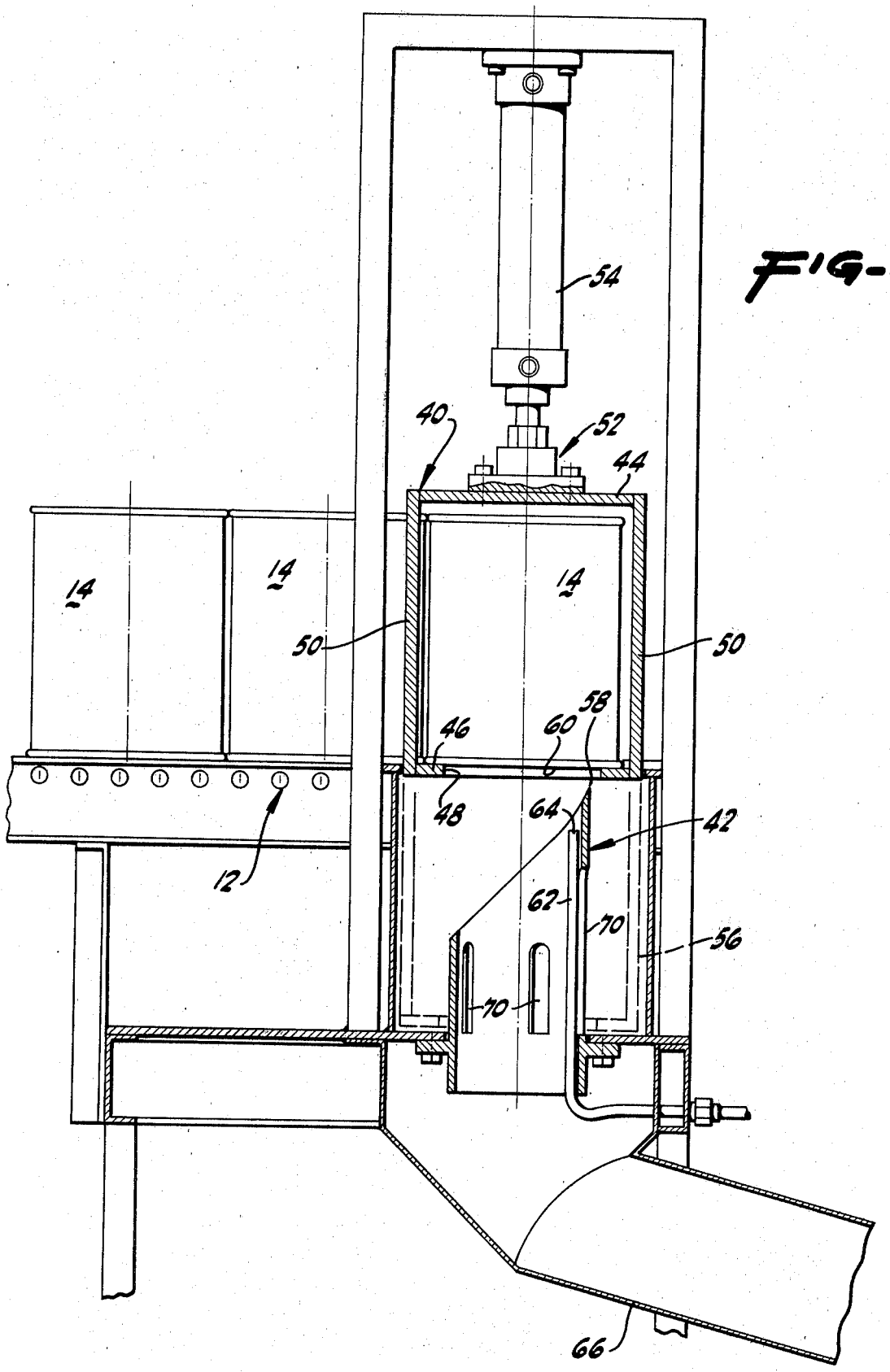
FIG. 3 is a sectional view taken along the line 3—3 in FIG. 1.

The can holder 40 has a top plate 44, a bottom plate 46 having a centrally disposed aperture 48, and side supports 50, all best shown in FIG. 3. As shown there, the inside dimensions of the can holder 40 are slightly in excess of the size of cans 14, so that they may be easily moved into and out of the can holder 40 by the positioning member 16. Can holder 40 is connected by linkage 52, to a second bi-directional pneumatic cylinder 54, which moves the can holder 40 between the position shown in FIG. 3 and the position represented by broken lines at 56, also in FIG. 3.

Knife edge 42 is arcuate shaped in a first direction, as best shown in FIG. 2. The arcuate shape has an apex 58 pointing upwards toward bottom 60 of the can 14 when the can is in position in can holder 40. Knife edge 42 also has a circular cross-section along its vertical length, shown best in FIG. 5. The radius of curvature of the cross-section is slightly less than the radius of the centrally disposed opening 48 of plate 46, so that the the knife edge 42 may pass through opening 48. A pressurized air line 62 extends upwards within knife edge 42 and has an opening 64 near apex 58 of the knife edge 42. A conduit 66 is positioned below the knife edge 42 to receive the contents of the cans 14 after they have been opened.

Figure 5:
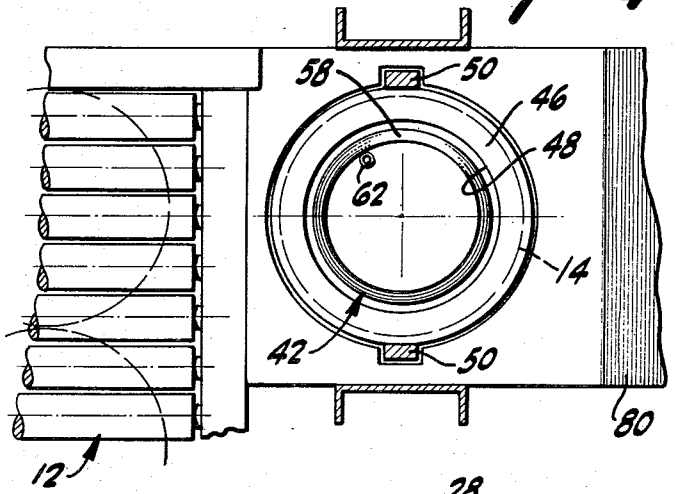
FIG. 5 is a sectional view taken along the line 5—5 in FIG. 2.
Figure 4:
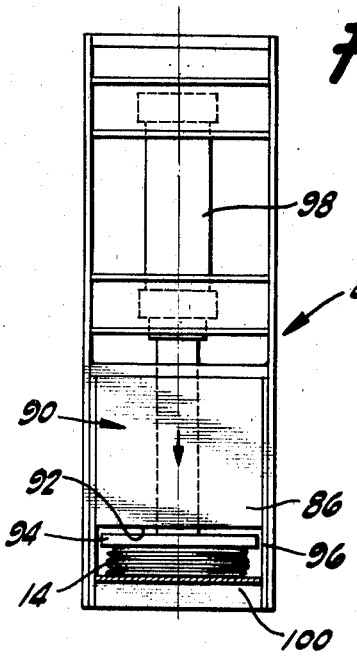
FIG. 4 is a sectional view taken along the line 4—4 in FIG. 2.

In operation, after the can 14 has been positioned in can holder 40, pneumatic cylinder 54 is actuated to move the can holder 40 downward to the position indicated at 56. As the can 14 moves downward within holder 40, knife edge 42 penetrates the bottom 60 of the can 14 to form a circular opening corresponding in size to the circular cross-section of knife edge 42 (FIG. 5). Paint in the can 14 drains through knife edge 42 to conduit 66 and then flows to container 68 (FIGS. 1 and 4). Openings 70 in knife edge 42 allow paint which flows outside the knife edge 42 to enter the conduit 66. As the can 14 moves down over the knife edge 42, air from the opening 64 in pressurized air tubes 62 serves to break any vacuum that may occur as the paint flows from the can 14, thus facilitating the removal of the paint from can 14.

After the can holder 40 has moved to the position indicated at 56, the pneumatic cylinder 54 is reversed to raise the holder 40 and can 14 back to the position shown in FIGS. 2, 3 and 5. The can opener is then ready for a successive cycle of operation. When positioning member 16 again moves to the right to move a second can 14 into the can holder 40, the second can 14 pushes the now empty first can 14 onto inclined conveyor 80, as shown at 82 (FIG. 2). The can then slides into crusher 84 until it rests against back side 86. (FIGS. 2 and 4). The crusher 84 includes an enclosure 90, closed on all sides except the side facing inclined conveyor 80 and opening 92 on the bottom of back side 86. A piston 94 is mounted in the enclosure 90 for reciprocation between the position shown in FIG. 2 and the position 96 in FIG. 4. The piston 94 is connected to a third bi-directional pneumatic cylinder 98 for movement between the two positions shown.

In operation, piston 94 moves down to position 96, as shown in FIG. 4, after the can 14 has entered the enclosure 84. The can 14 is then crushed against bottom 100 of the enclosure 90. Piston 94 is then reciprocated back to the position shown in FIG. 2 by pneumatic cylinder 98, and the crushed can 14 slides through opening 92 and down inclined conveyor 101. The can may then be carried away by another roller conveyor (not shown) and any paint squeezed out of the can collected in a receptacle (not shown) positioned beneath the end of inclined conveyor 101.

Figure 6:
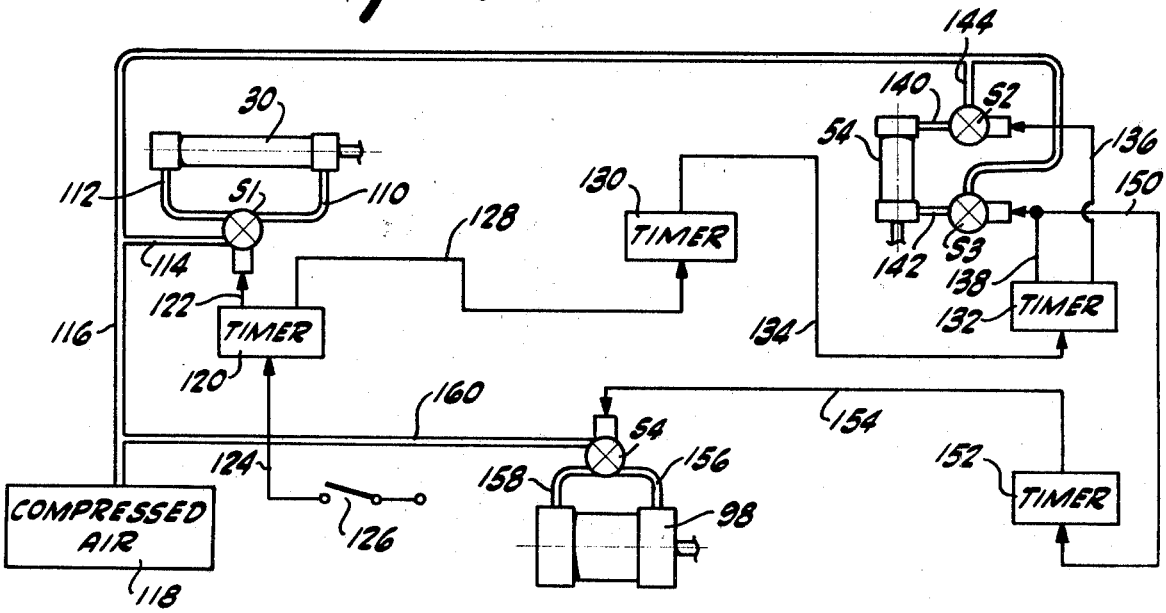
FIG. 6 is a block diagram of control circuitry and apparatus for the can opener shown in FIGS. 1–5.

FIG. 6 shows control circuitry for activating the pneumatic cylinders 30, 54 and 98, also shown in FIGS. 1–4. Solenoid valve S1 is connected to the pneumatic cylinder 30 by pneumatic lines 110 and 112. Lines 114 and 116 connect solenoid value S1 to a source 118 of compressed air. Timer 120 is connected to control operation of solenoid valve S1 by line 122. Line 124 connects switch 126 to timer 120. Line 128 connects timer 120 to a second timer 130, which is, in turn, connected to a third timer 132 by line 134. Timer 132 is connected to control operation of solenoid valves S2 and S3 by lines 136 and 138, respectively. The solenoid valves S2 and S3 are connected to second pneumatic cylinder 54 by pneumatic lines 140 and 142, respectively. Pneumatic lines 144 and 116 connect the solenoid valves S2 and S3 to the source 118 of pressurized air. Line 150 connects output line 138 of timer 132 to an input of timer 152. The output of timer 152 is connected by line 154 to control operation of solenoid S4. Solenoid S4 is connected to pneumatic cylinder 98 by pneumatic lines 156 and 158. Solenoid S4 is also connected to the source 118 of pressurized air by pneumatic line 160.

In operation, the timers 120, 130, 132 and 152 control operation of the solenoid valves S1 through S4 to produce the sequence of operation described above for the can opener 10. The sequence is initiated by closing switch 126. While the delay times of the timers 120, 130, 132 and 152 suitable for operation of the can opener and crusher 10 may be established within the skill of the art, a representative specific example is set forth below:

| Timer | Delay |
|---|---|
| 120 | 1.5–15 seconds (ON) |
| 130 | 0.5–5 seconds (ON) |
| 132 | 5–50 seconds (OFF) |
| 152 | 1.5–15 seconds (ON) |

It should now be apparent to those skilled in the art that a can opener and crusher capable of achieving the stated objects of the invention has been provided. This can opener and crusher will rapidly open and remove the contents from, and crush, cans on a mechanized basis. It is therefore especially adapted for use in a high volume manufacturing environment.

It should further be apparent to those skilled in the art that various changes in form and details of the invention as shown and described may be made. It is intended that such changes be included within the spirit and scope of the claims appended hereto.

What is claimed is:

1. A can opener, comprising:

(a) a knife edge dimensioned and configured to penetrate a can end, (b) means for positioning a can having two ends with one end disposed over said knife edge, (c) means for urging the can downward against said knife edge with sufficient force to cause said knife edge to penetrate the one end of the can, (d) means for receiving contents from the can disposed beneath said knife edge, said knife edge being arcuate shaped in a first direction, having an apex pointing toward the one end of the can, and being arcuate shaped in a second direction orthogonal to the first direction, with the arcuate shape in the second direction having a radius of curvature less than a radius of curvature of the one end of the can, and (e) a pressurized fluid tube connected to a source of fluid under pressure, said fluid tube having an opening proximate to said knife edge for supplying fluid to the can for urging contents from the can, said fluid tube extending along the arcuate shape in the second direction toward the apex of said knife edge.

2. The can opener of claim 1 additionally comprising a means for crushing the opened can and squeezing out any remaining contents.

3. The can opener of claim 2 in which said positioning means includes a pushing member having at least two surfaces for pushing laterally against a side of the can.

4. The can opener of claim 3 in which said positioning means and said crushing means are joined by an inclined conveying means along which said can passes after its contents are removed.

5. The can opener of claims 1, 3 or 4 in which the can is positioned by said positioning means on a ring shaped support having a centrally disposed opening through which said knife edge passes while penetrating the one end of the can.

* * * * *